US007024993B2

(12) United States Patent
Goss

(10) Patent No.: US 7,024,993 B2
(45) Date of Patent: Apr. 11, 2006

(54) SCREEN PRINTING MACHINE INCLUDING EXPOSURE UNIT

(75) Inventor: Duke W. Goss, 127 10th St. S. Suite 600, Kirkland, WA (US) 98033

(73) Assignee: Duke W. Goss, Kirkland, WA (US)

( * ) Notice: Subject to any disclaimer, the term of this patent is extended or adjusted under 35 U.S.C. 154(b) by 94 days.

(21) Appl. No.: 10/635,085

(22) Filed: Aug. 5, 2003

(65) Prior Publication Data

US 2005/0081727 A1 Apr. 21, 2005

Related U.S. Application Data

(63) Continuation-in-part of application No. 10/243,177, filed on Sep. 13, 2002, now Pat. No. 6,883,425.

(51) Int. Cl.
*B41F 15/12* (2006.01)
*B41F 15/34* (2006.01)
*B41L 13/14* (2006.01)

(52) U.S. Cl. ..... 101/128.4; 101/127.1; 101/126; 101/115

(58) Field of Classification Search ..... 101/114, 101/115, 126, 128.21, 128.4, 129, 123, 124, 101/127, 127.1, 474
See application file for complete search history.

(56) References Cited

U.S. PATENT DOCUMENTS 5,127,321 A * 7/1992 Proffer ..... 101/115
5,355,791 A 10/1994 Benedetto
5,622,108 A 4/1997 Benedetto et al.
5,648,189 A * 7/1997 Newman ..... 430/22
5,921,176 A * 7/1999 Oleson ..... 101/114
6,101,938 A * 8/2000 Adams ..... 101/126

* cited by examiner

*Primary Examiner*—Leslie J. Evanisko
(74) *Attorney, Agent, or Firm*—Delbert J. Barnard

(57) ABSTRACT

An exposure unit and a work piece support table are interchangeably mounted on an elongated, horizontal support arm. The support arm is a part of a screen-printing machine that includes a post to which one end of the support arm is connected. The post includes a rotor to which a plurality of printing screens are attached. The rotor is rotated to successively place the printing screens above the exposure unit. After the printing screens are exposed, they are removed from the rotor and washed to remove from them an unexposed portion of a coating that was applied to the printing screen. This unexposed portion of the coating is washed away, leaving a positive image on the screen where the washed away material was once located. This positive image reason will pass ink. After the printing screens have been prepared, the exposure unit is removed from the support arm and is replaced on the support arm by a work piece supporting table. A work piece is positioned on the table. Then, the printing screens are moved into position about the work piece, one at a time. Each is moved down onto the work piece and ink is applied to it for printing a positive image represented by the pattern on the printing screen. The exposure unit is provided with locator pins. A plurality (e.g. three) light transmitting, positive image carriers are positioned on the light transmitting top of the exposure unit. Each positive image carrier includes a plurality of locator pin openings in which the locator pins are received. The locator pins and the locator pin openings serve to position the positive image carrier in a predetermined position on top of the work piece.

27 Claims, 15 Drawing Sheets

SCREEN PRINTING MACHINE INCLUDING EXPOSURE UNIT

RELATED APPLICATION

This application is a continuation-in-part of my application Ser. No. 10/243,177 filed Sep. 13, 2002, and entitled Screen-Printing Device, now U.S. Pat. No. 6,883,425 B2, granted Apr. 26, 2002.

TECHNICAL FIELD

This invention relates to screen-printing. More particularly, it relates to a screen-printing machine that is constructed to facilitate its use during the various stages of screen-printing.

BACKGROUND OF THE INVENTION

Preparatory to screen-printing, artwork and/or indicia that is to be printed must be placed on the print screen. This is commonly done by creating the image on the print screen by use of a process that requires the presence of a light box or exposure unit that includes ultraviolet lighting. The light box and print screen need to be supported during the imaging procedure. A photographic emulsion is applied to the print screen and then the print screen is dried in the dark before exposure of the emulsion. After exposure, the screen is washed to remove a part of the emulsion that was not hardened by the ultraviolet light. Then, an article to be printed, i.e. a work piece, such as a garment, must be supported. The print screen must be properly positioned on the work piece and supported in that position. Then, ink is applied to the print screen for the purpose of printing the image on the work piece. At times, it is desired to apply heat to the printed work piece to increase the drying speed of the ink. There is a need for a screen-printing device that facilitates the performance of all of the above described functions and makes possible the quick and easy handling of the components and a proper positioning of the print screen relative to the first light box and then the work piece. An object of this invention is to provide a screen-printing device that fulfills this need.

For background purposes, reference is made to my aforementioned U.S. Pat. No. 6,883,425 B2 and to U.S. Pat. No. 5,355,791, granted Oct. 18, 1994, to John R. Benedetto and William Gillespie, and to U.S. Pat. No. 5,622,108, granted Apr. 22, 1997, to John R. Benedetto, William Gillespie, James W. Palmeroy, Duke Goss and Charles J. Palmeroy, and to the reference patents listed in these patents.

BRIEF SUMMARY OF THE INVENTION

The screen-printing machine of the present invention is basically characterized by an exposure unit having a light transmitting top, a light below the top, and a frame member bordering the top. The frame member includes a plurality of spaced apart locator pins that extend upwardly from the frame member. A light transmitting, positive image carrier is positionable on said light transmitting top. The positive image carrier includes a plurality of locator openings in which the locator pins are received. The locator pins and the locator pin openings serve to position the positive image carrier in a predetermined position on the top of the exposure unit. A positive image is positioned at a predetermined location on the positive image carrier.

According to another aspect of the invention, a second light transmitting positive image carrier is positionable on the first light transmitting positive image carrier. The second positive image carrier also includes a plurality of locator openings in which the locator pins are received. The locator pins and the locator pin openings serve to position the second positive image carrier in a predetermined position on top of the first positive image carrier and on top of the exposure unit. A second positive image is positioned at a predetermined location on the second positive image carrier relative to the first positive image on the first positive image carrier.

The invention includes providing a third positive image carrier positionable on the second positive image carrier. The third positive image carrier includes a plurality of locator openings in which the locator pins are received. The locator pins and the locator pin openings serve to position the third positive image carrier in a predetermined position on the second positive image carrier. A third positive image is positioned at a predetermined location on the third positive image carrier relative to the second positive image on the second positive image carrier and relative to the first positive image on the first positive image carrier.

Another aspect of the invention includes providing a printing screen that is positionable above the positive image carrier and the exposure unit. In preferred form, the printing machine includes first and second screens or first, second and third screens, selectively positionable, one at a time, over the exposure unit.

According to a further aspect of the invention, the printing machine is provided with a common support for the exposure unit and the printing screen or screens. When on the support and positioned above the exposure unit, each printing screen occupies a predetermined position.

When more than one printing screen is used, each printing screen is positioned on the support so as to be selectively and individually positionable above the exposure unit by rotation of the support.

Preferably, there is a detachable pin and socket connection between the support and the printing screen. This allows the printing screen to be detached from the support and then reattached to the support at substantially the same position that it previously occupied.

Preferably, the common support includes an elongated, horizontal support arm and the exposure unit includes a tubular member having a center passageway that is sized and shaped to receive the support arm. A clamp is provided for clamping the exposure unit onto the support arm.

In the preferred embodiment, the screen-printing machine comprises a main frame that includes an elongated, horizontal support arm. The exposure unit includes a tubular member having a center passageway that is sized and shaped to receive the support. A clamp is provided for clamping the exposure unit onto the support arm.

In the preferred embodiment, the screen-printing machine comprises a main frame that includes an elongated, horizontal support arm. There is an exposure unit and a work piece table that are interchangeably mounted in a predetermined position on the support arm. The exposure unit is first employed to help provide a positive image on a printing screen.

In another embodiment, a printing screen mounting frame member is provided that includes an elongated arm that extends perpendicular from a center portion of the frame member. This arm extends into the center passageway of the tubular member that is built into the exposure unit. The clamp associated with the tubular member is used to clamp onto this arm for the purpose of locating the frame member in a desired position relative to the exposure unit. The frame member includes sockets for receiving pins that are on an end portion of the printing screen. This allows the printing screen to be detachably secured to the frame member in a proper position relative to the exposure unit.

Another object of the invention is to provide an exposure unit that includes a set of black lights (ultraviolet lights) and a set of white lights. The white lights are used during preparation of the print screen and the black lights are used for exposing the emulsion on the print screen. A control circuit for the black lights may be provided which includes a switch having an operator that is depressed when the print screen is set down onto the light box or exposure unit. As it moves downwardly, a frame portion of the print screen contacts and depresses the switch operator and the switch control circuit operates to turn on the black lights.

BRIEF DESCRIPTION OF THE SEVERAL VIEWS OF THE DRAWING

Like reference numerals are used to designate like parts throughout the several views of the drawing, and.

DETAILED DESCRIPTION OF THE INVENTION

Figure 1:
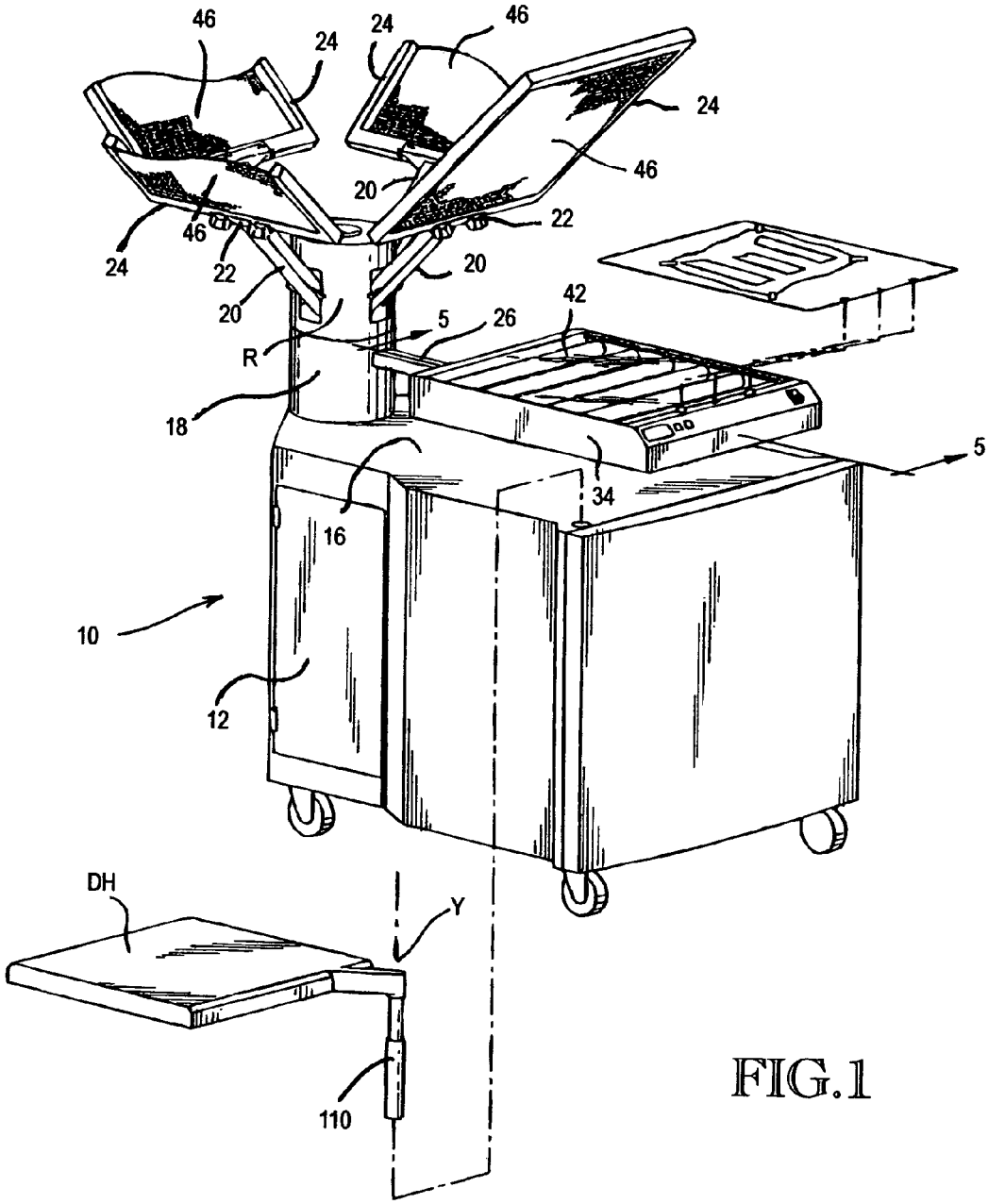
FIG. 1 is a pictorial view of a screen-printing machine, showing an exposure unit or light box mounted on a support arm, a positive image carrier in a spaced relationship to the light transmitting exposure unit, and a heating unit in spaced relationship to the main housing portion of the machine.

The screen-printing device 10 shown by FIG. 1 includes a base 12 that is preferably a cabinet or housing having a front door or cover 14. When a cover 14 is used, it is movable in its entirety onto and off from the front of the housing 12. A housing having a snap-on, pull-off cover is shown by my U.S. Pat. No. D 471,734S, granted Apr. 8, 2003.

The cabinet 12 has a top 16 and at its rear includes a post 18 that serves as a screen frame support. A plurality of swing arms 20 are connected at one end to a rotor R on top of the post 10 for pivotal up and down movement about a horizontal axis. A clamp 22 is mounted on the second or outer end of the swing arm 20. The clamp 22 provides a detachable connection between it and a screen frame 24. In FIG. 1, four swing arms 20 are shown attached to the rotor R. Each arm 20 is pivotally connected at its first or inner end to the rotating upper portion of the rotor R and each supports a clamp 22 at its second or outer end.

Figure 5:
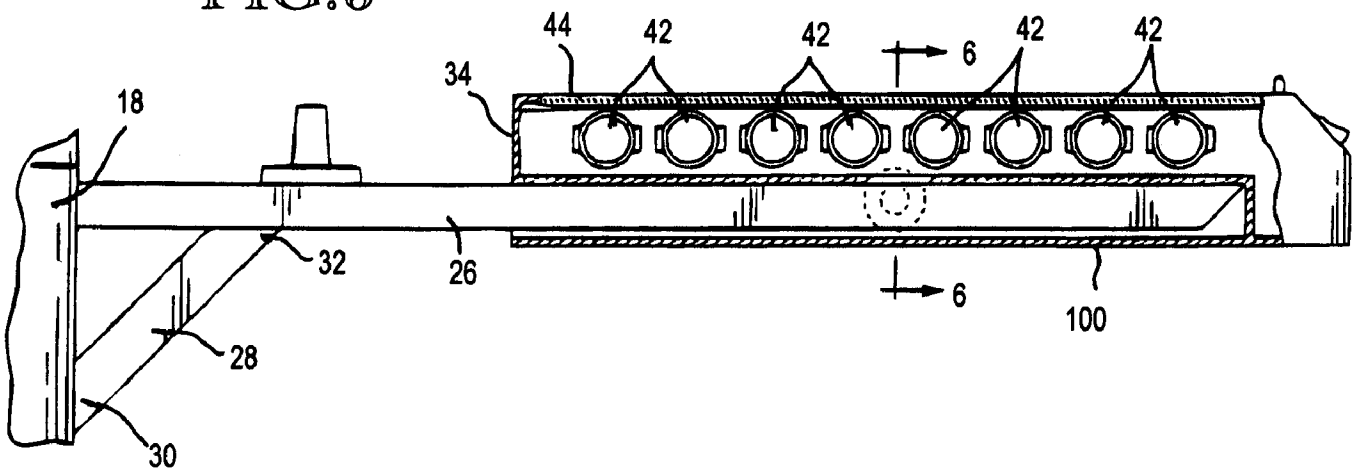
FIG. 5 is a sectional view taken substantially along line 5—5 of FIG. 6, with some parts in side elevation.
Figure 18:
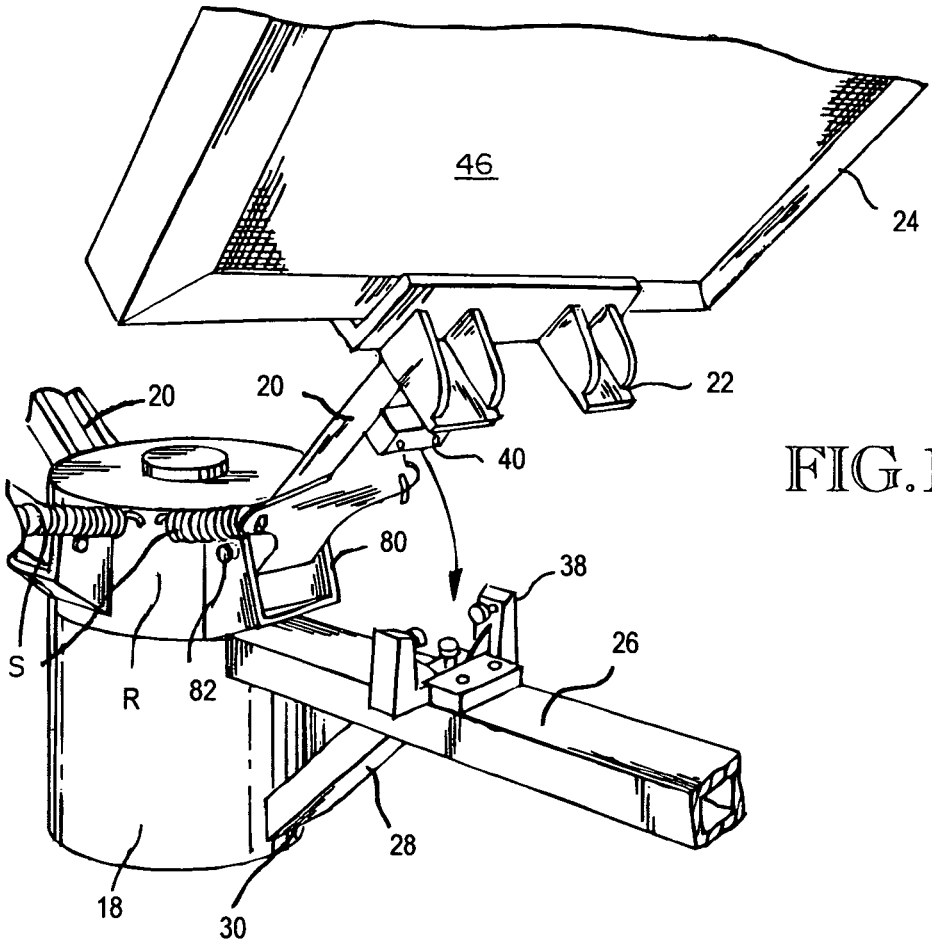
FIG. 18 is a fragmentary pictorial view of a lower portion of the clamp and a swing arm which mounts the clamp onto the mounting post, such view showing a portion of an elongated support arm that extends forwardly in can-lever fashion from the mounting post, such arm including a cradle for receiving a portion of the swing arm.

As shown by FIGS. 1 and 18, a support arm 26 projects horizontally outwardly from the non-rotating lower portion of the post 18. This support arm 26 is best shown in FIGS. 5 and 18. Support arm 26 may include a diagonal brace 28 having a lower end 30 that is connected to the lower end of the post 18 and an upper portion 32 (FIG. 5) that is connected to the arm 26 at a location spaced outwardly from the post 18. As best shown by FIG. 5, the brace 28 may extend at an angle of approximately 45 degrees (45°) relative to both post 18 and arm 26.

Figure 10:
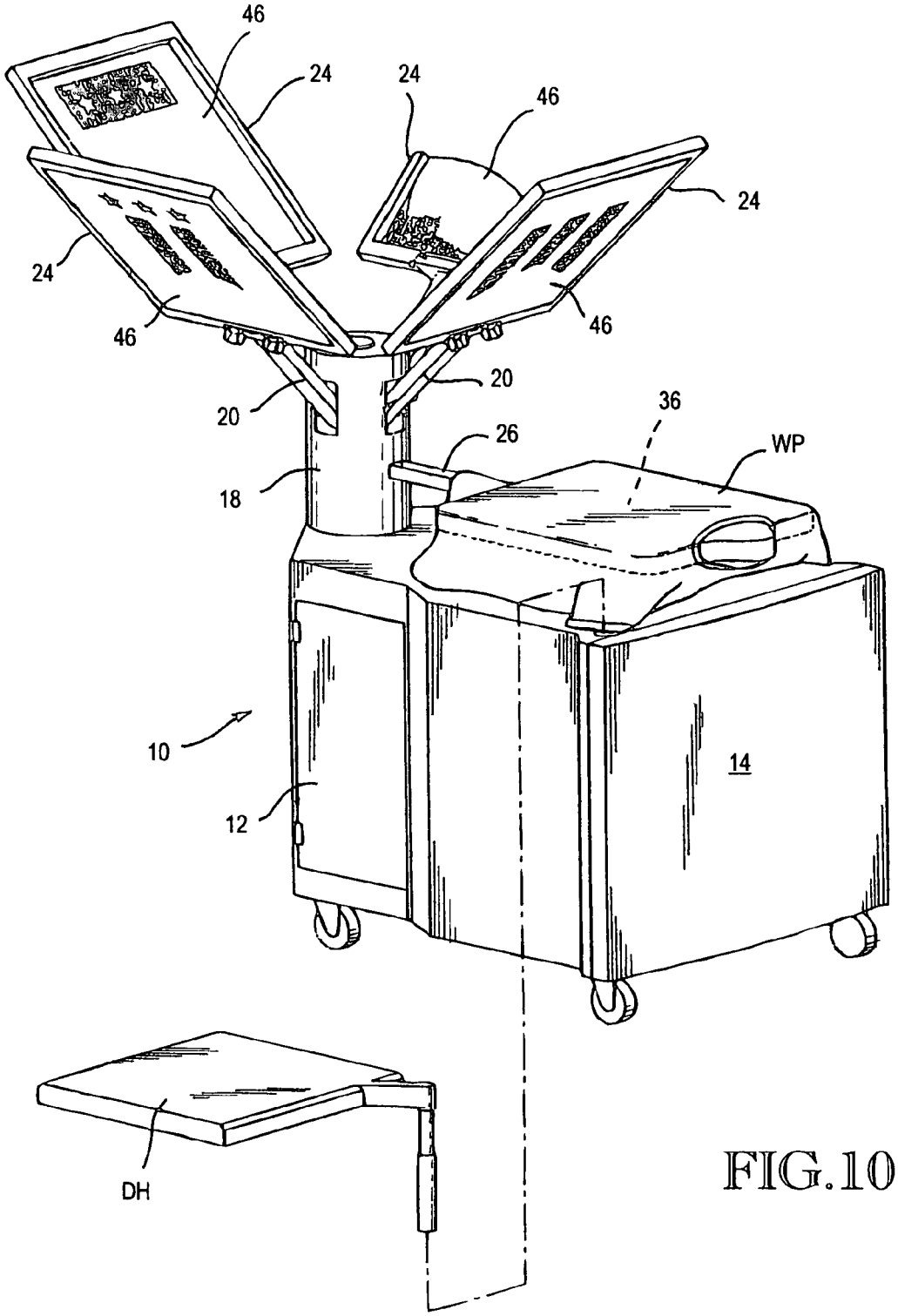
FIG. 10 is a view like FIG. 1, but showing the exposure unit removed from the support arm and replaced on the support arm by a work piece support table, and showing a work piece on the support table and the printing screens ready for use to print an image on the work piece.
Figure 11:
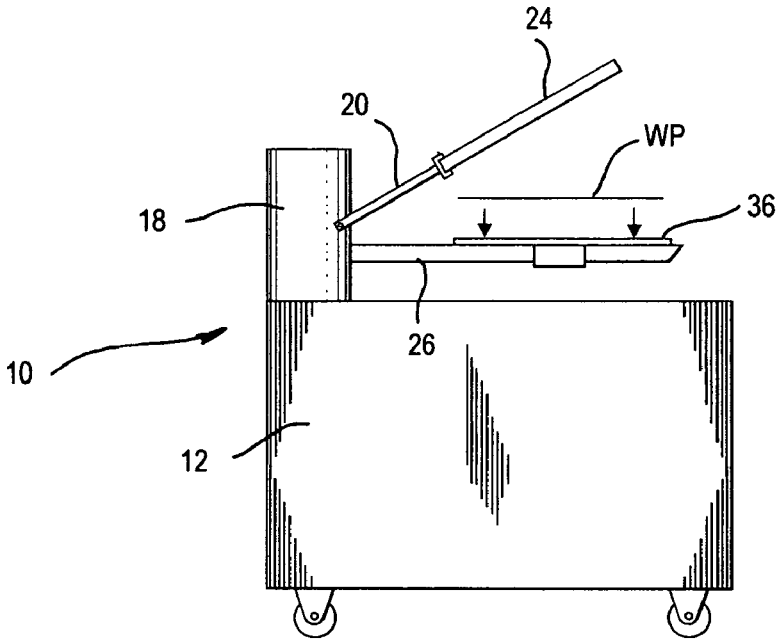
FIG. 11 is a view like FIG. 7, but showing a printing screen in an up-position and a work piece below it spaced above the work piece support table.
Figure 12:
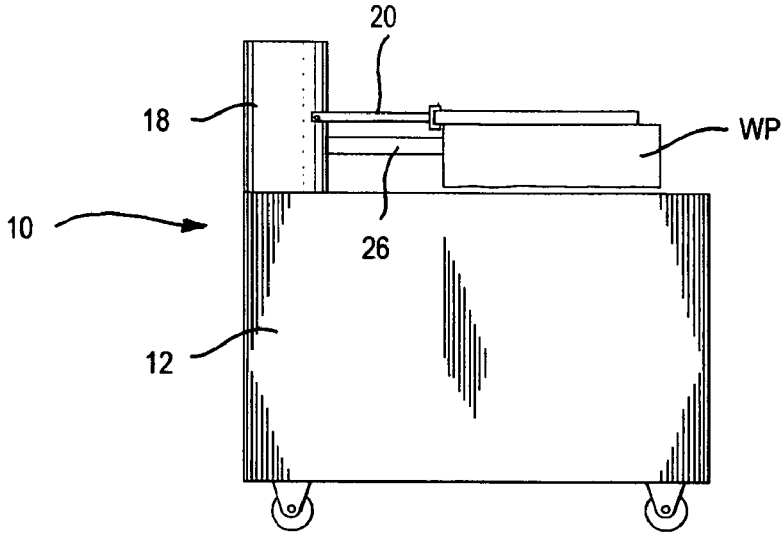
FIG. 12 is a view like FIG. 11, but showing the work piece down on the work piece support table and showing the printing screen in a down position on the work piece.

Support arm 26 forms three support functions. Firstly, it supports a light box 34 that is slideable endwise onto and off from the support arm 26. Secondly, support arm 26 supports a workpiece support table 36 (FIG. 10) that is also slideable endwise onto and off from the support arm 26. Thirdly, support arm 26 supports and positions the swing arms 20. As shown by FIG. 18, support arm 26 includes a cradle 38 that is positioned to receive a portion of each swing arm 20 that is between the inner and outer ends of the support arm 20. The construction and operation of the cradle 38 and a locator block 40 that is on each support arm 20 are more thoroughly disclosed and described in my aforementioned U.S. Pat. No. 6,883,425 B2. That patent is hereby incorporated herein in its entirety by this specific reference to it.

Figure 2:
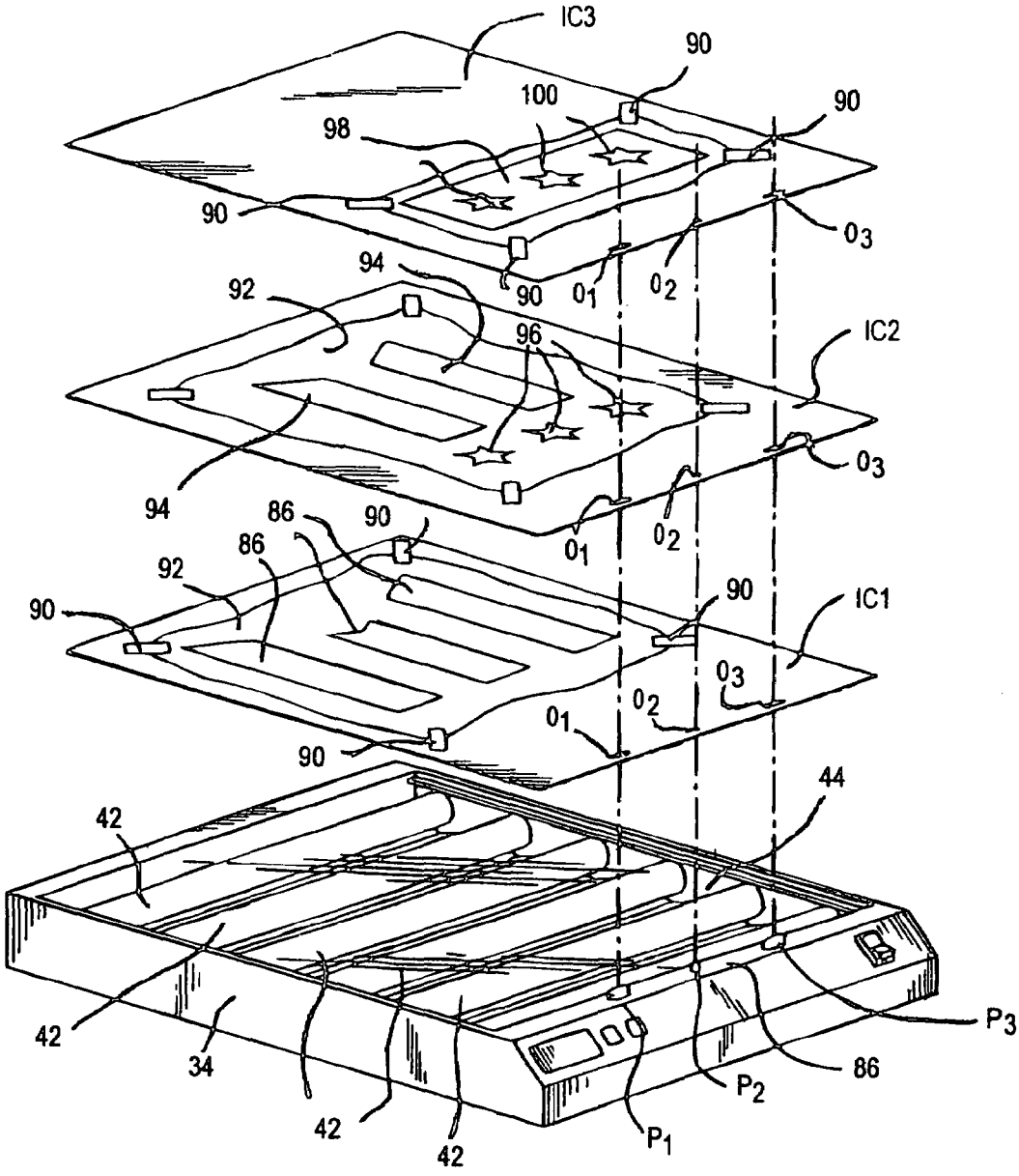
FIG. 2 is an enlarged scale pictorial view of the exposure unit and three positive image carriers spaced apart above the exposure unit, with alignment openings in the image carriers aligned with alignment pins that are at one end of the exposure unit.
Figure 6:
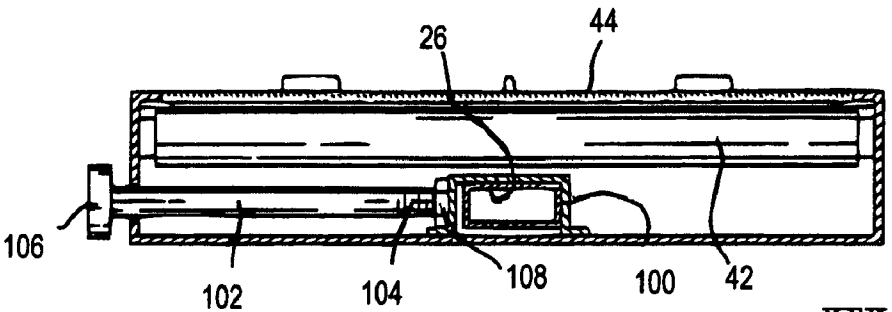
FIG. 6 is a sectional view taken substantially along lone 6—6 of FIG. 5, with some parts in side elevation.

The exposure unit or light box 34 is best shown by FIGS. 2, 5 and 6. It has a bottom, two sides and two ends. A plurality (e.g. five to eight) fluorescent lamps 42 are mounted side-by-side in the light box 34. These fluorescent lamps 42 emit ultraviolet (UV) light. The arrangement of the lamps 42 is well known and for that reason does not need to be described herein in any great detail. The top of the light box 34, above the lamps 42, is closed by a light-transmitting panel 44. This may be a clear panel 44 but preferably is a translucent panel 44 that is adapted to diffuse the light that is emitted from the several lamps 42. The use of a diffuser panel 44 is also well known.

Each screen frame 24 is in the nature of a tray. Each has two sides and two ends that are connected together at four corners. The sides and ends may be constructed from tubular stock, e.g. square aluminum tubing (see FIG. 19). The screen frame 24 has a rectangular plan form and its top is open. Its bottom is closed by a print screen 46 that is formed from a fine mesh fabric. Print screen 46 is stretched across the side and end members of screen frame 24 and is connected to the members in a well-known manner. The mesh size (strands per inch) is a variable. Print screens have been used which fall in the range of about 25 strands per inch to about 495 strands per inch, with the larger number of strands creating detail images.

Figure 16:
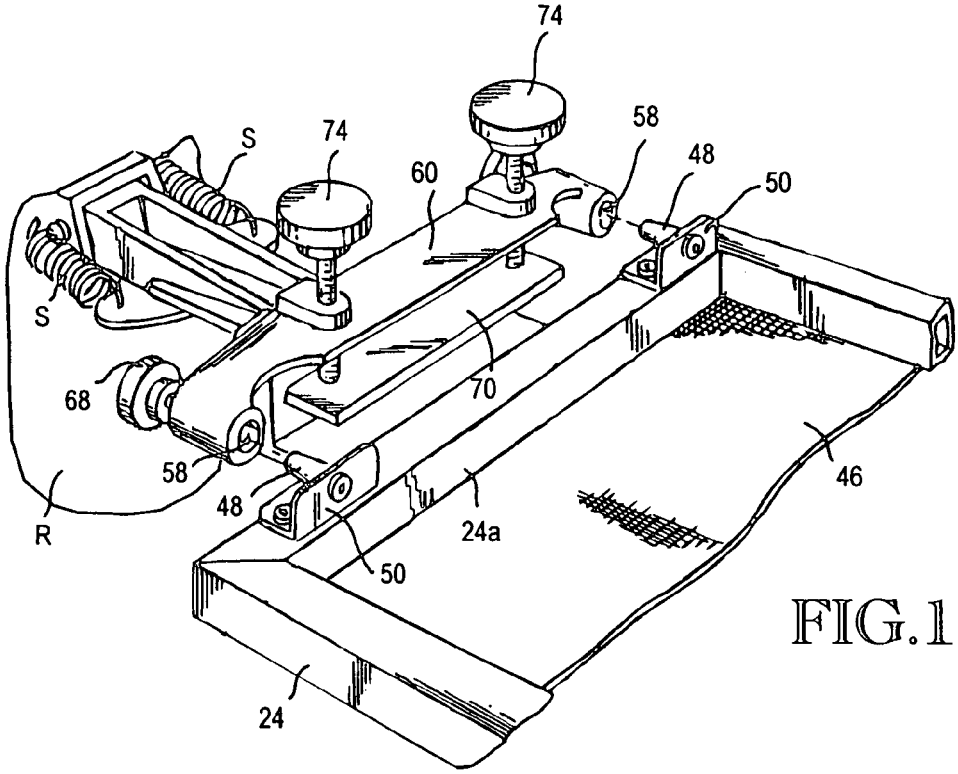
FIG. 16 is a fragmentary pictorial view of the end portion of a screen frame spaced outwardly from a screen frame support that includes a clamp for detachably connecting the screen frame to a mounting post.
Figure 17:
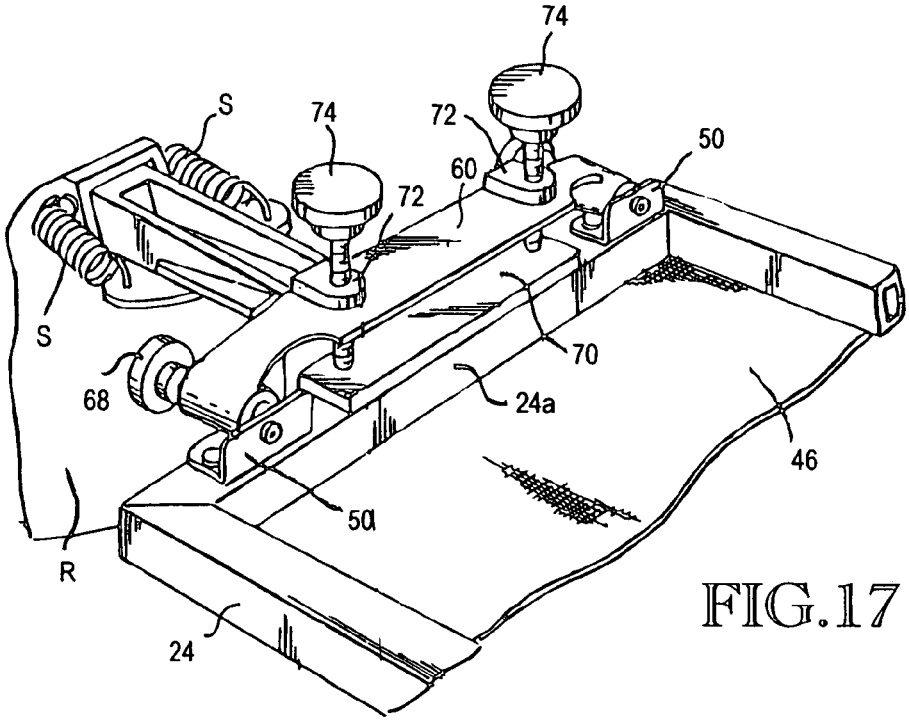
FIG. 17 is a view like FIG. 16, but showing the clamp connected to the end portion of the screen frame.
Figure 19:
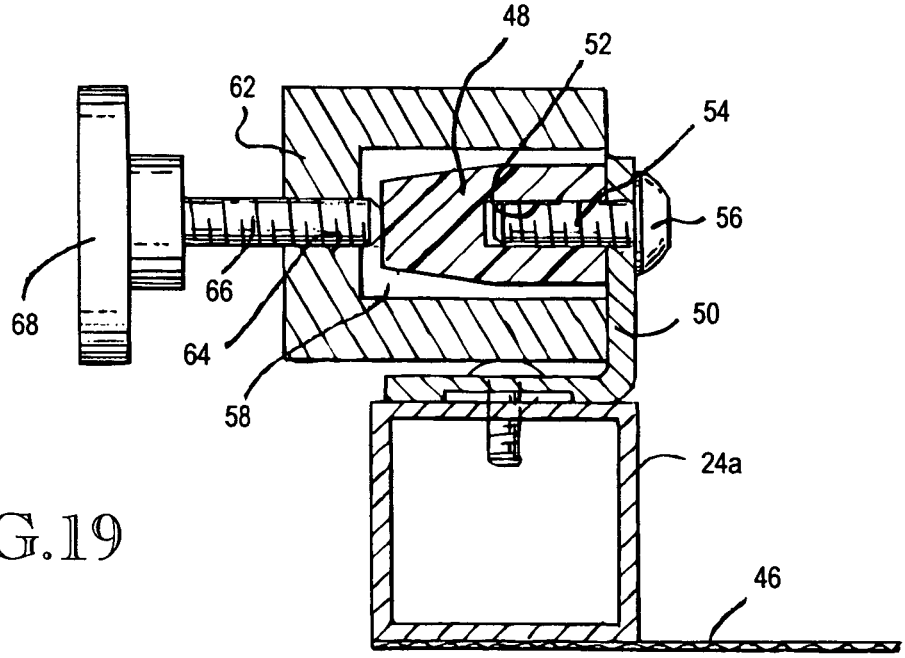
FIG. 19 is a sectional view taken substantially along line 19—19 of FIG. 17.
Figure 20:
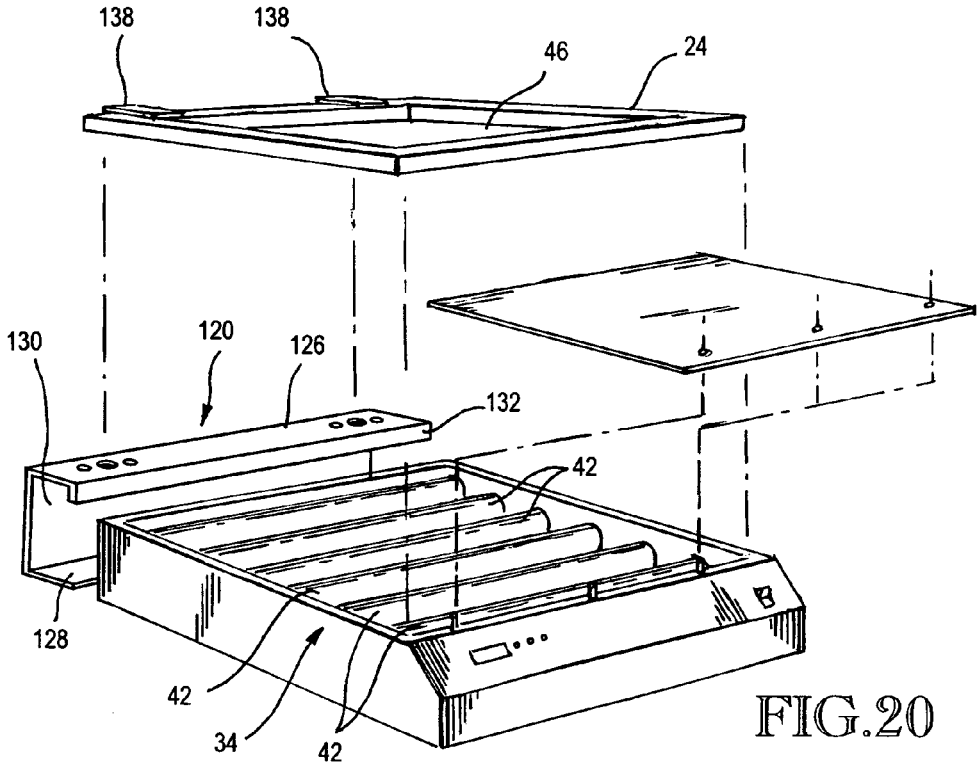
FIG. 20 is a pictorial view of a modified printing screen and light box assembly.
Figure 21:
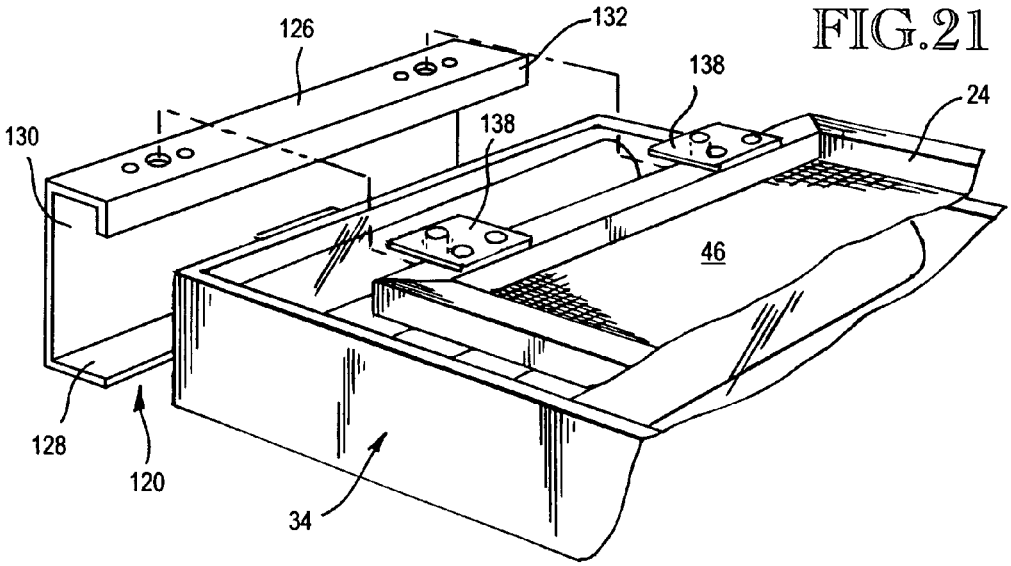
FIG. 21 is an enlarged scale fragmentary view of the rear end of the assembly shown by FIG. 20, with the printing screen set down on the light box and spaced forwardly from the frame member to which the printing screen is adapted to be connected.
Figure 22:
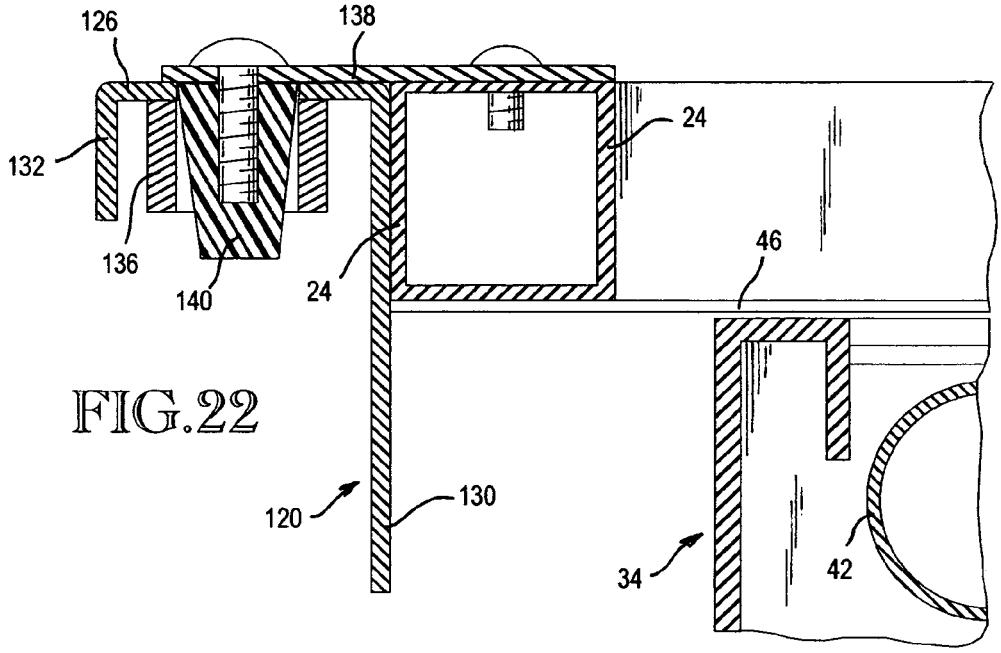
FIG. 22 is a fragmentary sectional view taken through rear end portions of the printing screen and the light box and an upper portion of the frame member to which the printing screen is attached.
Figure 23:
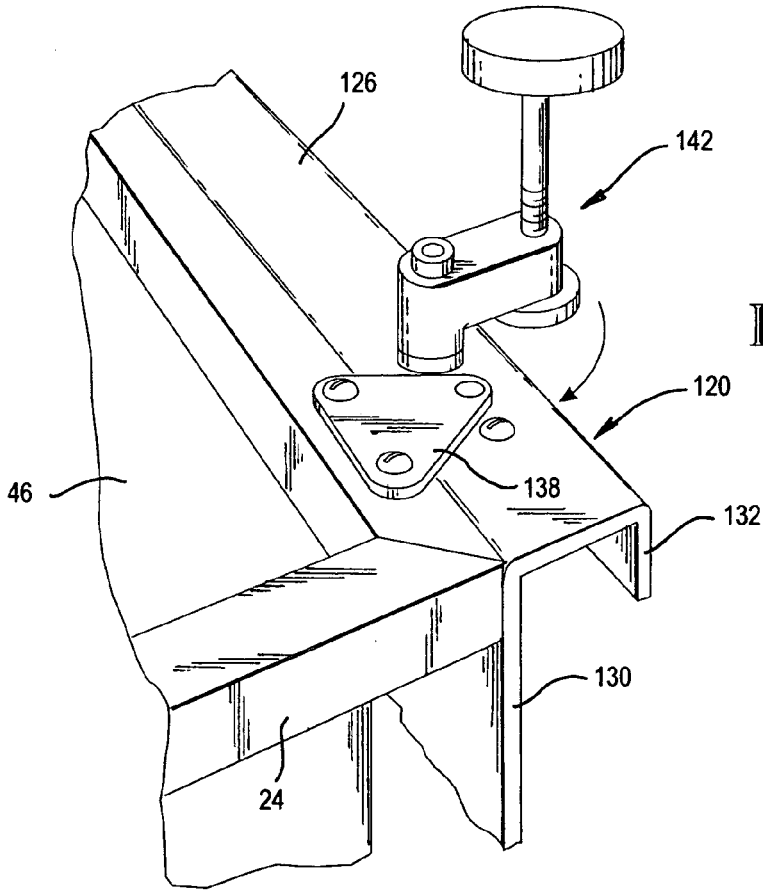
FIG. 23 is a fragmentary pictorial view of an embodiment which includes a clamp member that is on the mounting frame member adjacent each of the locator pins that are on the printing screen frame, such view showing the clamp swung into an unclamped position.
Figure 24:
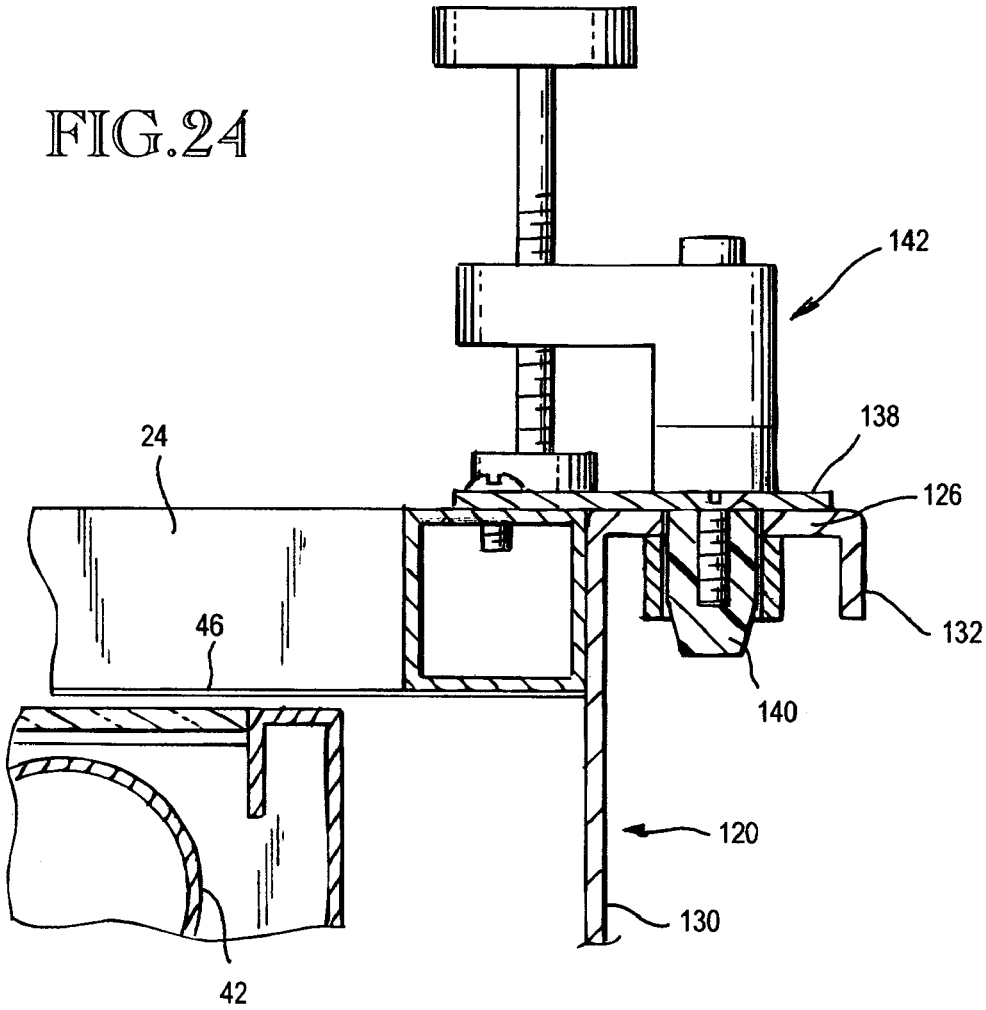
FIG. 24 is a fragmentary sectional view of the assembly shown by FIG. 23, but showing the clamp swung into a clamped position.

According to an aspect of the invention, a substantially precise connection is made between each screen frame 24 and the clamp structure 22. As best shown by FIGS. 16, 17 and 19, a pair of horizontal locator pins 48 may be provided at one end of the screen frame 24. A pair of angle members 50 are provided, one for each locator pin 48. The horizontal leg of each angle member 50 is connected to the frame member 24*a* (FIG. 19), such as by use of screws, bolts or rivets. The locator pins 48 are mounted on the vertical legs of the angle members 50. As shown by FIG. 19, each locator pin 48 may include a socket 52, which is internally threaded for receiving the threaded shank 54 of a screw 56. Screw 56 connects the locator pin 48 to the vertical leg of the angle member 50.

The clamp structure 22 may include a socket member 58 at each end of a transverse frame member or bar 60. As shown by FIG. 16, each socket member 58 is formed in a member that includes a rear wall 62 (FIG. 19) through which an internally threaded opening 64 extends. The threaded shank 66 of a screw 68 is received within each opening 64. Screw 68 is rotated for the purpose of adjusting the depth that the locator pin 48 is allowed to extend into the socket 58. As shown by FIG. 19, the first half of the locator pin is cylindrical and the second half, or remaining portion, tapers as it extends towards the rear wall 62 of the socket 58. This taper facilitates insertion of the locator pins 48 into the sockets 58. As shown by FIG. 16, the socket 58 has a width that is substantially equal to the width of the locator pin 48 where it is attached to the vertical leg of the angle member 50. In the vertical direction, the socket 58 is elongated. This oval construction of the socket 58 will allow some vertical movement of the locator pin 48 in the socket 58 while sideways movement is substantially prevented.

Referring to FIG. 16, the bottom of each clamp structure 22 includes a bottom wall or plate 70 on which a lower surface of the frame member 24*a* rests. As shown by FIGS. 16 and 17, the clamp structure 22 includes a pair of thickened areas 72 which include vertical openings that are threaded to receive threaded shanks of adjustment screws 74. Each adjustment screw 74 includes a knob at its upper end. The threaded shank extends into and is turnable within openings formed in a clamp plate 60. When the adjustment screws 74 are rotated, the threaded shank portions of the screws 74 are also rotated and they move up and down in the openings in the member 72. The adjustment screws 74 rotate relative to the clamp plate 70 and clamp plate 70 moves up and down with the adjustment screws relative to the clamp plate 60.

When it is desired to connect the screen frame 24 to the clamp 22, the knobs 74 are rotated in the direction that moves the clamp plate 70 towards the clamp plate 60. When the vertical space below plate 70 is greater than the thickness of the frame member 24*a*, the screen frame 24 is moved towards the clamp structure 22 to place the locator pins 48 in the sockets 58. When the locator pins 48 are within the sockets 58, as far as they will go, and the frame member 24*a* is between the plates 60, 70 and the necessary adjustments have been made by adjustment screws 68, the clamp screws 74 are rotated in the direction that causes the clamp plate 70 to move downwardly towards and against the frame member 24*a*.

Referring to FIG. 18, the rotor R at the top of the post 18 includes, for example, four mounting brackets 80. Each mounting bracket 80 is secured to the rotor R and has spaced apart sidewalls. The inner ends of the swing arms 20 are positioned between the sidewalls of the mounting brackets 80. A pivot pin 82 extends first through one sidewall, then through the inner end of the swing arm 20, and then through the second sidewall of the bracket 80. Pin 82 provides a pivot axis about which the swing arm 20 pivots. Each bracket 80 includes a stop on which its swing arm 20 rests. Springs S extend between the rotor R and portions of the swing arms 20 that are spaced outwardly from the pivot pins 82. The springs S pull on the swing arms 20, tending to pull them upwardly and away from the cradle 38. Each swing arm 20 includes the aforementioned block 40 that depends from the swing arm 40 at a location between where the springs are attached to arm 20 and the clamp structure 22. When a swing arm 20 is moved downwardly, the springs S will stretch, permitting the movement. The block 40 on the swing arm 20 will enter into the cradle 38, as can be seen by FIG. 18. The cradle 38 and its cooperation with the block 40 are well described in my aforementioned U.S. Pat. No. 6,883,425 B2. They form a part of the invention to which that application relates. As described in U.S. Pat. No. 6,883,425 B2, each cradle 38 includes adjustment screws that are adjusted for the purpose of providing a predetermined position of the block 40 in the cradle 38. When the swing arm 20 is down, the block 40 rests on the head of a first adjustment screw that extends substantially vertically. As will be appreciated, adjustment of the screw will provide a way of positioning the screen frame 24 in a substantially horizontal position, over either the light box 34 or the workpiece support 36. Adjustment of a pair of confronting side screws will adjust the sideways position of the screen frame 24 relative to the support arm 26 and either the light box 34 or the work piece support 36.

As shown by FIGS. 5 and 6, an elongated socket 100 is formed in the lower central portion of the light box 34. It receives the support arm 26. A long adjustment screw 102 (FIG. 6) having a threaded end portion 104 and a knob 106, extends through one side of the light box 34. The threaded portion 104 threads into a nut 108 that is connected to a sidewall of the socket 100. The threaded portion 104 extends through the nut 108 and through an opening in the sidewall of the socket 100. When adjustment screw 102 is tightened, by rotation of the knob 106, the inner end of the screw 102 presses against the support arm 26 and clamps the light box 34 to the support arm 26. The work piece support 26 also includes an elongated socket 110 that is sized to receive the support arm 26. The socket 110 may also include an adjustment screw having a knob at its outer end. This knob is rotated to tighten the screw. As the screw is tightened, it clamps the socket 110 to the support arm 26. When the screw is rotated in the opposite direction, its inner end portion moves away from the support arm 26 and the socket 110 and the work piece support 36 are free to be slid endwise onto or off from the support arm 26.

As previously stated, a separate printing screen 24 is connected to each clamp structure 22. Adjustments may then be made so that each of the print screens 24 will be in a proper position relative to either the light box 34 or a work piece on the work piece support 36. The light box 34 can be removed from the support arm 26 and replaced by the work piece support 36 and the print screen 24 will remain in a proper position. The same is true when a switch is made from the work piece support 36 back to the light box 34. Also, the screen frame 24 can be removed and then replaced and it will come back to the same position it was in before it was removed. The other printing screens attach to the other swing arms 20 and are adjusted so that they will also be in a proper position relative to the light box 34 and the work piece support 36 when it is their turn to be in a front position over either the light box 34 or the work piece support 36.

U.S. Pat. No. 6,883,425 B2 shows other forms of locator pin structure, some including other forms of clamp structure. Their use is a part of the present invention but because they are both illustrated and described in U.S. Pat. No. 6,883,425 B2, they will not be specifically illustrated and described in this application, except by this incorporation by reference.

Multicolor pictures, designs, etc. are printed one color at a time. A separate one of the printing screens 24 is used for each color. A first color is printed on an object (e.g. a shirt). Then, a second color is printed on the same object. Then, a third color is printed on the same object, etc. The screen-printing device of the present invention is adapted to prepare the images on the several printing screens 24 in such a way that adjacent colors do not overlap or are spaced apart too much on the finished article.

The printing machine shown by FIG. 1 has four printing screens 24 and thus can print four different colors without the need to replace one or more of the screens 24. By way of example, the printing of a three-color design will now be described. This design utilizes the colors red, white and blue and in the example is printed on a fourth color. The color gray is selected as the fourth color and it is the color of the object that is being printed. In this example, this object is a gray sweatshirt.

In the example, only three of the four printing screens 24 will be used. Three positive image carriers IC1, IC2, IC3 are used. Each positive image carrier is positionable on the light transmitting top 44 of the exposure unit 34. As best shown by FIG. 2, the exposure unit has a frame member 86 that extends along one of its sides. This frame member 86 is provided with a plurality of locator pins P1, P2, P3. Preferably, locator pin P1 is elongated in the length direction of the frame 86. Locator pin P2 may be a cylindrical pin. Locator pin P3 may be like pin P1. In this example, each of the positive image carriers IC1, IC2, IC3 includes three locator pin openings O1, O2, O3. Locator pin openings O1, O3 are sized and shaped to snugly receive the locator pins P1, P3. Locator opening O2 is sized and shaped to receive the locator pin P2.

Each positive image carrier 80, 82, 84 is made from a light transmitting material such as MYLAR. This material is relatively strong and clear and the locator pin openings O1, O2, O3 can be formed in the material without any substantial damage to the material. The positive image carriers 80, 82, 84 are preferably of like size and are sized to substantially cover the top member 44 on top of the exposure unit 34.

Figure 3:
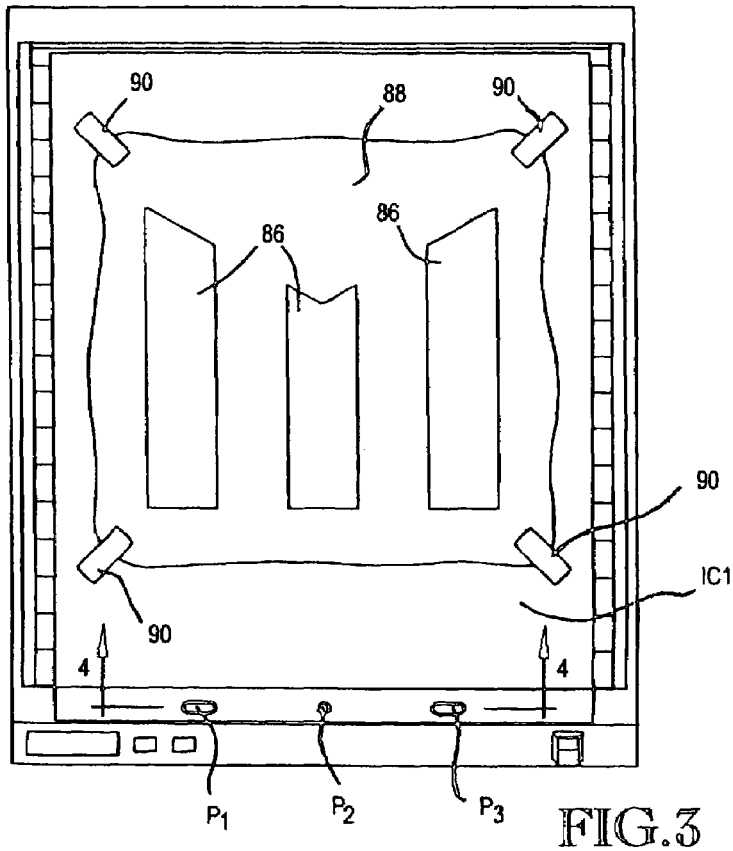
FIG. 3 is a plan view of a first positive image carrier that is positioned on the exposure unit by use of the alignment pins and openings.
Figure 4:
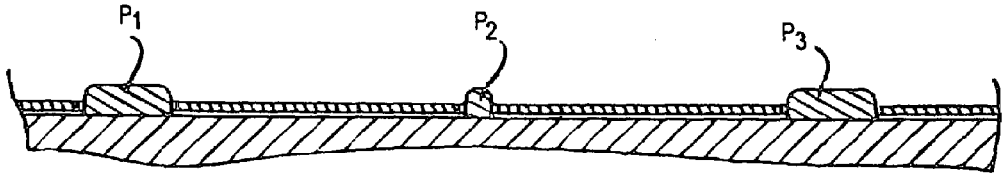
FIG. 4 is an enlarge scale fragmentary sectional view taken substantially along line 4—4 of FIG. 3.

In the chosen example, the first positive image carrier IC1 is provided with a positive of the "red" portion of the red, white and blue design. It is shown in the form of three stripes 86. According to an aspect of the invention, three stripes 86 are printed or otherwise applied to a smaller light transmitting film 88. Image carrier 80 is secured to the exposure unit 34 by use of the locator pins P1, P2, P3 and the locator pin openings O1, O2, O3, as is shown in FIG. 3. Then the smaller film 88 is placed on top of the film IC1 and is set in a predetermined position. Then, clear tape strips 90 are used to attach the film 88 to the film IC1. Then, the second positive image carrier IC2 is set down onto the first positive image carrier IC1. This is not illustrated but it can be visualized, particularly when FIG. 2 is considered. Referring to FIG. 2, let it be assumed that positive image carrier IC1 is moved downwardly onto the glass top 44 with the locator pins P1, P2, P3 within the locator pin openings O1, O2, O3. This will end up with the arrangement that is shown by FIG. 3. Next, visualize the positive image carrier IC2 being moved downwardly on top of the positive image carrier IC1. Again, the locator pin openings O1, O2, O3 are positioned to receive the locator pins P1, P2, P3. This establishes a set position of the carrier IC2 relative to the carrier IC1. Then, the film 92 is placed on the positive image carrier IC2 and is moved until the positive images 94, 96 be properly positioned relative to the positive images 86. This is done by sliding the film 92 over the film 88 until the strip regions 94 are substantially exactly between the stripe regions 86 and the ends of the stripe regions 94 are substantially even with the ends of the stripe regions 86. When this position is accomplished, additional clear tape strips 90 are applied to connect the film 92 to the carrier IC1. Lastly, a third positive image carrier IC3 is set down onto the second positive image carrier IC2. Its locator pin openings O1, O2, O3 are positioned to receive the locator pins P1, P2, P3. When this is accomplished, the positive image carrier IC1 is laying on the glass top 44. The positive image carrier IC2 is lying on the positive image carrier IC1. The positive image carrier IC3 is lying on the positive image carrier IC2. The locator pins P1, P2, P3 extend through aligned locator pin openings, O1, O2, O3 in the stack of carriers IC1, IC2, IC3.

When positive image carrier IC3 is in place, a third film 98 is set down on it. This film has a solid rectangular shape in which star shaped openings 100 have been formed. This film 98 is slid in position on the carrier 84 until the star shaped openings 100 are substantially exactly aligned with the star shaped positive images 96 on the film 92. Also, the side boundary of the rectangular member is positioned in a substantially abiding relationship with the squared ends on the stripe positives 94. When member 98 is properly positioned, it is taped down to the carrier IC3 by use of additional strips of clear tape 90.

Figure 7:
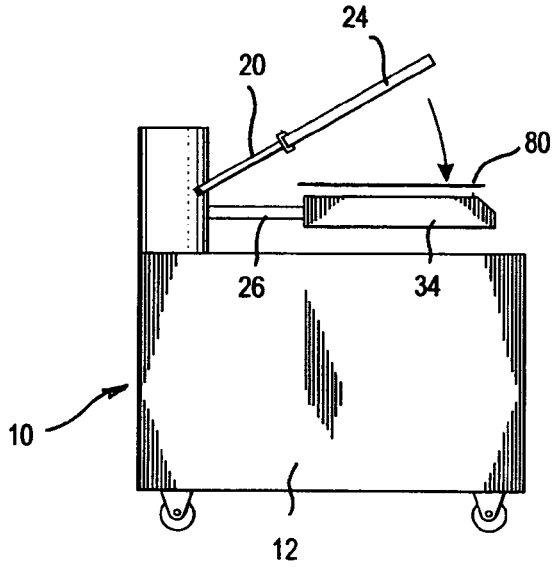
FIG. 7 is a side elevational view of the printing machine shown by FIG. 1, showing the printing screen in an up position and the positive image carrier spaced above the exposure unit.
Figure 8:
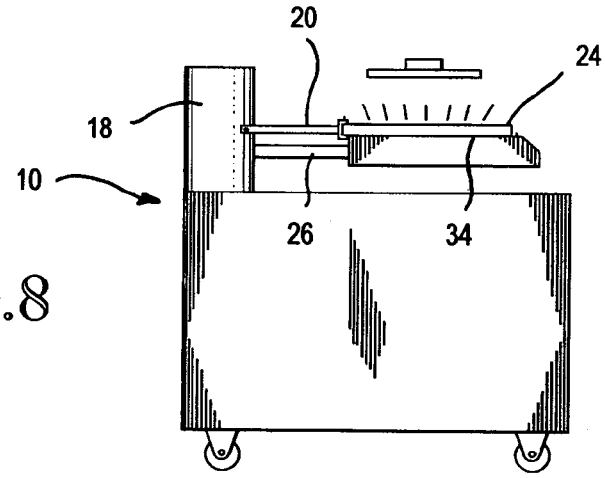
FIG. 8 is a view like FIG. 7, but with the positive image carrier positioned on the exposure unit and the printing screen on the positive image carrier and with the exposure unit being operated to expose the emulsion on the printing screen.
Figure 9:
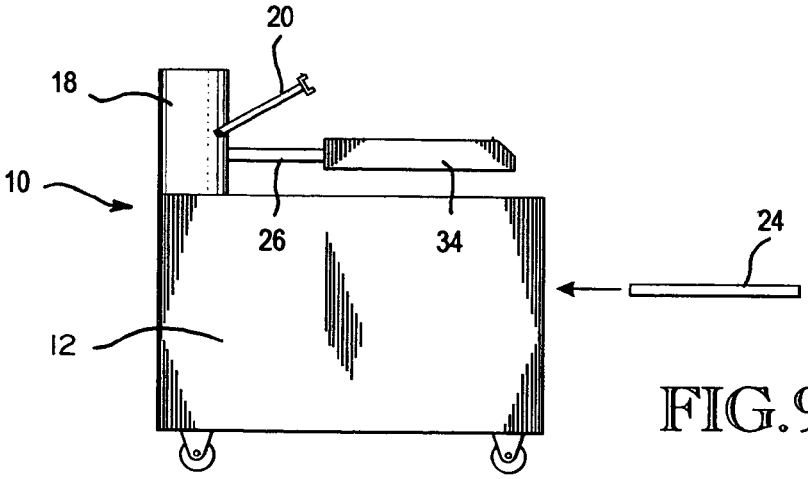
FIG. 9 is a view like FIGS. 7 and 8, but showing the printing screen removed from its support and in the process of being moved into a housing that forms the base of the printing machine.

Next, the top two positive image carriers IC2, IC3 are removed from the stack, leaving the lower positive image carrier IC1 on the glass 44. A first one of the printing screens 24 is moved into a position above the exposure unit 34. This is shown in FIG. 7. Then, the printing screen 24 is swung downwardly to place it on the positive image carrier IC1. The mesh 46 is provided with a coating on its top. With the printing screen 24 down, and the mesh material 46 lying on the carrier IC1 and the film 88, the exposure unit is turned on. That is, the lights 42 are turned on. The light emitting from the light tubes 42 will pass through the carrier material IC1 and the film 92 except in the regions of the stripes 86. The stripes 86 are opaque and they will block the passage of light where they are situated. Following this exposure, the screen is removed, is taken to a sink, for example, and a washing solution is applied to the coating on the mesh member 46. This wash solution will wash off the coating in the regions above the positive patterns 86. This is because in these regions the light did not contact the coating. In the remaining regions of the mesh 46 where the coating was contacted by the light, the coating is "fixed" by the light and will not be removed by the wash solution. Next, the printing screen 24 is swung upwardly off from the exposure unit 34. The positive image carrier IC1 is removed and is replaced by positive image carrier IC2, again using the locator pins P1, P2, P3 and the locator pin openings O1, O2, O3 for positioning the carrier IC2 on the exposure unit 34. Then, the assembly of printing screens 24 is rotated to place a second printing screen 24 over the carrier. This second screen also has a coating on the top of its mesh member 46. The above-described procedure is then repeated. That is, the second printing screen 24 is moved downwardly on top of the second positive image carrier IC2. The light is turned on for the purpose of exposing the coating on the mesh material where the light is not blocked by the positive images 94, 96. Following exposure, the washing solution is applied to remove the portion of the coating that was not exposed to the light. Following washing, the second printing screen 24 is moved to an up position. The positive image carrier IC2 is removed and replaced by the positive image carrier IC3. The rotor R is again rotated until the third printing screen 24 is positioned above the exposure unit 34. Then, the third printing screen 24 is moved downwardly on top of the positive image carrier IC3. The light is again turned on so that the light will pass upwardly through the image carrier 90, the film 98 and the tape 90; except in the region that is blocked by the positive image on the film 98. As before, the coating on the third printing screen is washed for the purpose of removing the portions of the coating that were not fixed by being contacted by the light. When washing is completed, the third printing screen 24 is raised and the image carrier 84 is removed from the glass member 44.

Figure 13:
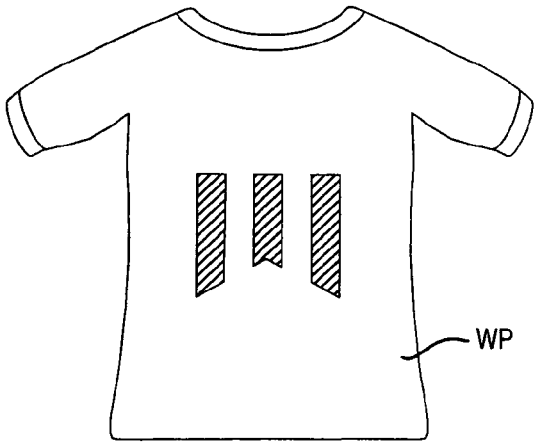
FIG. 13 is a plan view of the work piece as it appears after the first portion of the positive is printed on it.

After all of the printing screens have been prepared, the exposure unit 34 is removed from the support bar 26 and is replaced by the work piece support 36. Then the work piece WP is placed on the work piece support and moved into a desired position relative to the design on the printing screen 24. At that time the first printing screen 24 is in an "up" position above the work piece support 36 and the work piece WP. Next, this printing screen 24 is moved downwardly to place it on top of the work piece WP. Then, ink is applied to the top of the mesh member 46. In the example, this ink is "red" ink and it is used to print the red stripes of the design on the work piece WP. A squeegee or other spreader is used to move the ink back and forth atop the mesh member 46. This causes the ink to pass through the openings in the mesh material 46 in the region of the stripes. Following this procedure, the first printing screen 24 is raised up off of the work piece WP but the work piece WP is not removed. Next, a drying heater DH maybe rotated about the axis Y of a support post 110 for positioning it over the ink image on the work piece WP. The drying heater DH directs heat against the ink, accelerating the drying of the ink. FIG. 13 shows the red stripes that have been printed on the work piece WP.

After the stripes have dried, the second printing screen 24 is rotated into a position above the work piece WP. Then, this printing screen 24 is swung downwardly, placing it on top of the work piece WP. Next, white ink is applied to the top of the mesh material 46. As before, a squeegee or other spreader is used to spread the ink over the openings in the mesh material 46. In the example, this causes three white stars and two white stripes to be printed on the gray work piece WP. The white stripes are positioned between the red stripes and the white stars are positioned endwise above the stripes. After the white ink is applied, the second printing screen 24 is raised and the drying heater DH is swung back into a position above the printed image on the work piece WP. The drying heater DH is left in place a sufficient amount of time to dry the white ink. Then, it is swung back out of the way and the third printing screen 24 is moved into a position above the work piece WP. It is then swung downwardly to place it on the work piece WP. Then, blue ink is applied to the top of this printing screen 24. The blue ink is spread by use of a squeegee or some other suitable tool to move it back and forth over the openings in the mesh material 46. After spreading is done, the third printing screen 24 is raised. Then, the drying heater DH is swung back over the work piece WP and used to dry the blue ink.

Figure 14:
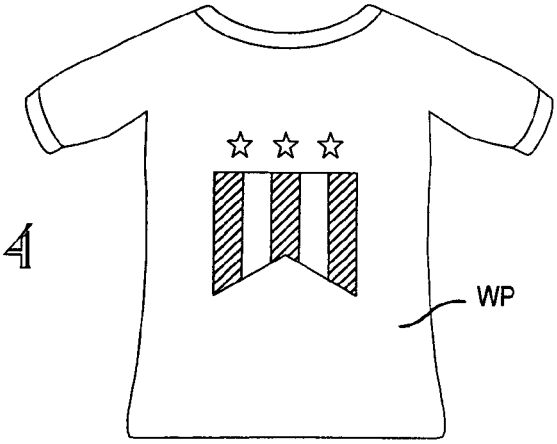
FIG. 14 is a view like FIG. 13, but showing the work piece as it appears after the second portion of the image is printed on it.
Figure 15:
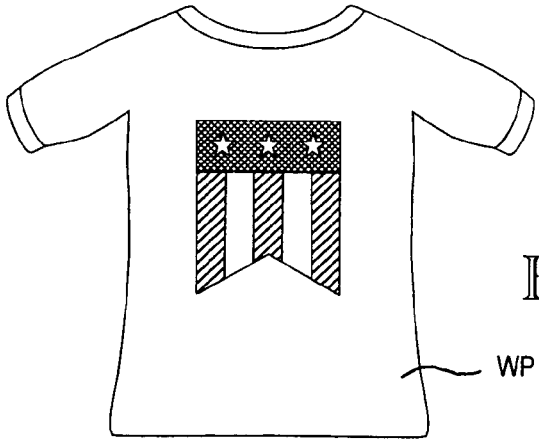
FIG. 15 is a view like FIGS. 13 and 14, but showing the work piece with the entire positive image printed on it.

FIG. 13 shows the red stripes only printed on the work piece WP. FIG. 14 shows the red stripes, the white stripes and the white stars printed on the work piece WP. FIG. 15 shows the red and white stripes, the white stars and the blue background for the stars printed on the work piece WP. The use of the positive image carriers IC1, IC2, IC3, the rotating printing screen carrier that places the printing screens 24 in exact positions above the work piece WP, and the locator pin assembly used to connect the printing screens to the swing arms 20 results in a relatively rapid application of a completed image on the work piece WP in which the several parts of the image are very accurately positioned each relative to the others.

Figure 25:
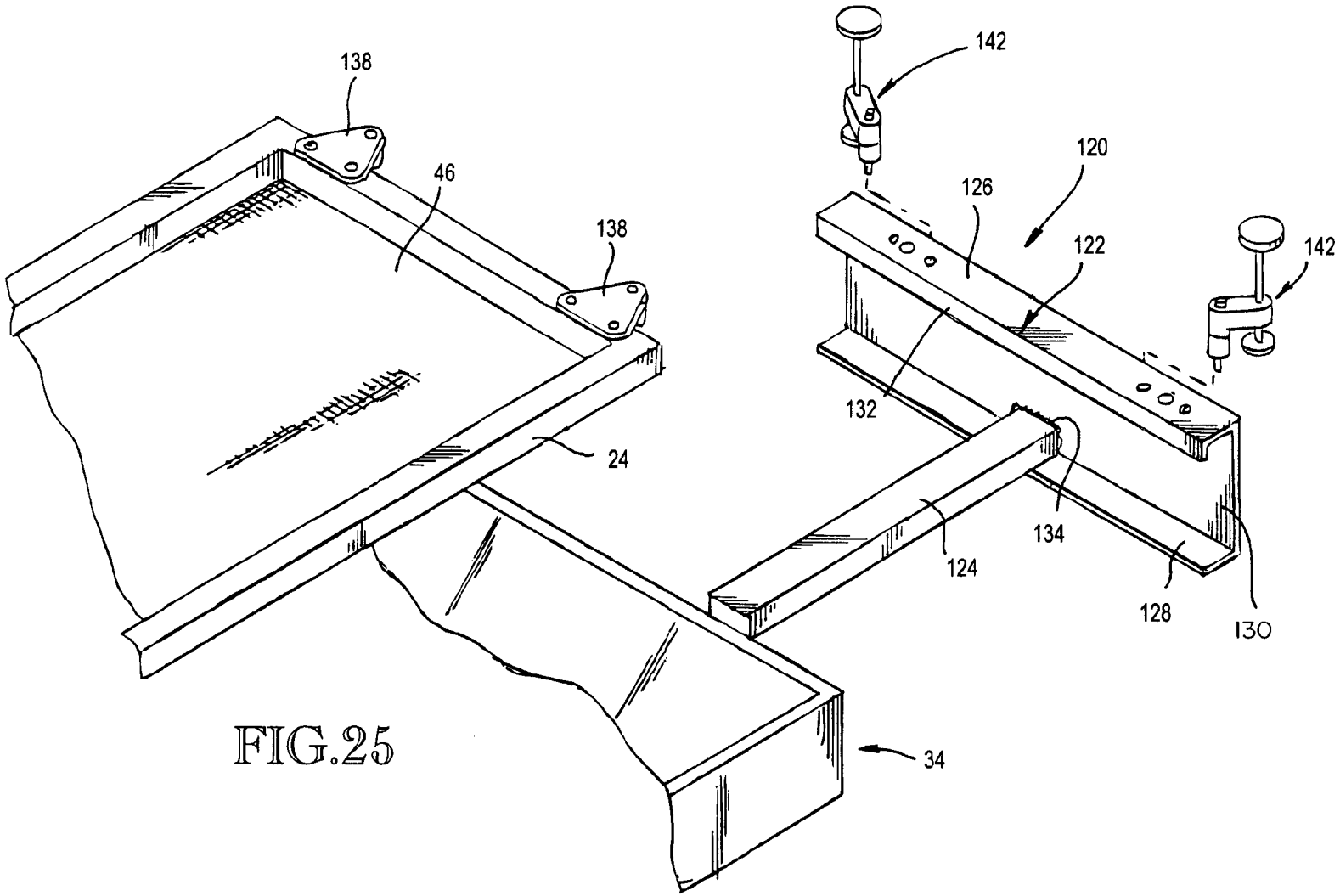
FIG. 25 is a fragmentary pictorial view of the mounting frame for the printing screen and longitudinal member that extends from the mounting frame into a tunnel opening in the light box.

The embodiment of FIGS. 20–27 is a simplified screen-printing machine composed of the exposure unit 44, one or more printing screens 24, 46, and a frame structure 120 that provides way of mounting the printing screen 24, 46 in a proper position relative to the exposure unit 34. As perhaps best shown by FIG. 25, the structure 120 comprises a frame member 122 and an elongated arm 124 that extends perpendicular from a central portion of the frame member 122. Arm 124 is essentially like arm 26, except that it is connected to the frame member 122 rather than to a frame member that is a part of a housing, such as shown by FIG. 1 and the other figures relating to the first embodiment. Frame member 122 may be a lipped channel member comprising vertically spaced apart upper and lower flanges 126, 128, a web 130 extending between the flanges 126, 128 and a lip 132 extending from the upper flange 126. The arm 124 is welded or otherwise secured to the web 130, at location 134 (FIG. 25).

Figure 26:
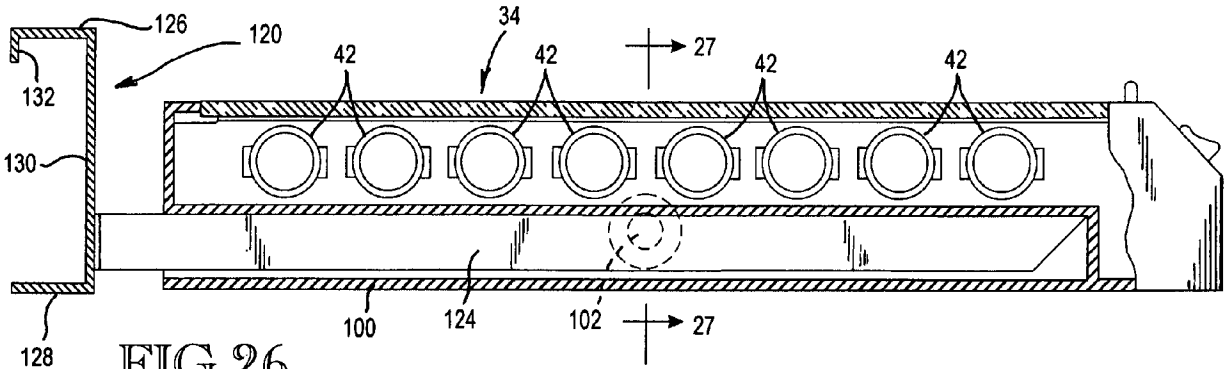
FIG. 26 is a longitudinal sectional view through the light box and the mounting frame member for the printing screen, such view showing the longitudinal frame member within the longitudinal socket in the light box.
Figure 27:
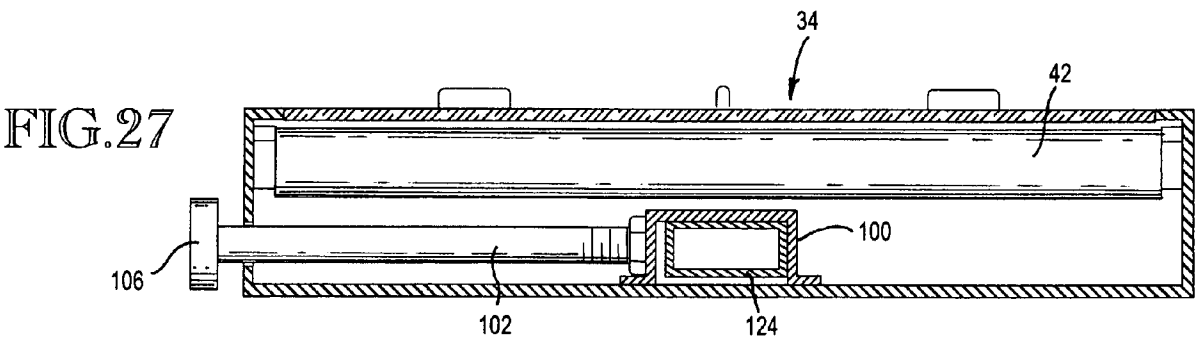
FIG. 27 is a sectional view taken substantially along line 27—27 of FIG. 26.

As shown by FIGS. 26 and 27, the arm 124 extends into the tubular member or socket 100 in the exposure unit. A clamp rod 102, controlled by a handle or knob 106, is provided to clamp the socket member 100 to the arm 124, in the manner that socket member 100 is connected to the arm 26 in FIGS. 5 and 6. In this embodiment, frame member 120 is provided with at least two spaced apart sockets 136 and the printing screen frame 24 is provided with a top plate 138 at each location of a socket 136. Each top plate 138 carries a tapered positioning pin 140. This structure for connecting the printing screen 24, 46 to the frame member 120 is like the structure that is shown by FIGS. 18 and 19 in the aforementioned copending U.S. Pat. No. 6,883,425 B2. The pins 140 may merely extend downwardly into the sockets 146, for clamps 142 may be provided in the manner shown by FIGS. 23–25. These clamps are like the clamps shown in FIGS. 20 and 21 of U.S. Pat. No. 6,883,425 B2. The description of these clamps presented in U.S. Pat. No. 6,883,425 B2 is hereby incorporated into this application by this specific reference.

In operation of the embodiment shown by FIGS. 20–25, the assembly 120, 124 is brought to the exposure unit 34 and the arm 124 is inserted into the socket 100. Then, the clamp structure 102, 106 is operated to clamp the arm 124 to the socket 100. This fixes the assembly 120, 124 in a proper fixed position relative to the exposure unit 34. Then, the printing screens 24, 26 are brought one at a time to the exposure unit 34. The locator pins 140 are placed into the sockets 136 and the clamps 142 are utilized if they are provided. The engagement of the pins 140 in the sockets 136 properly positions the printing screen 24, 46 relative to the exposure unit 34. With this equipment, the other steps that have been described above can be practiced, including the steps that are shown in and are described in conjunction with FIGS. 2–12. In this embodiment, the exposure unit 34 can also serve as the work piece support table. For example, if a t-shirt is being printed, the t-shirt can be placed on top of the exposure unit 34. Then, the printing frame 24, 46 can be set down onto the exposure unit, over the t-shirts, and the ink can be applied in the manner described above. If desired, a covering piece (e.g. plastic sheet) can be placed on top of the exposure unit 34 when it is being used as a support for the work piece.

Figure 28:
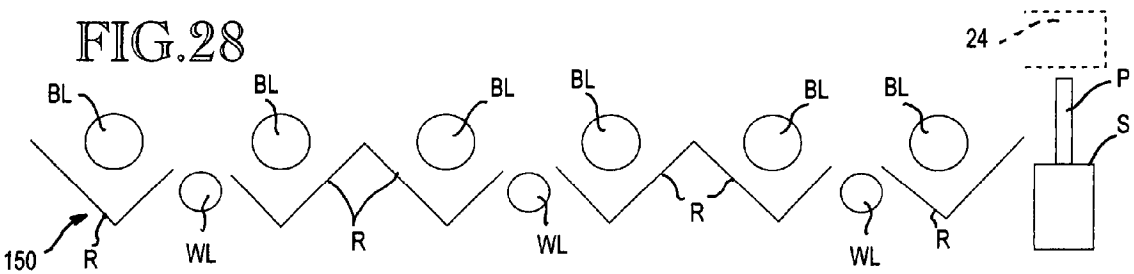
FIG. 28 is a schematic view of a modified light box, which includes both black lights and white lights.

FIG. 28 is a diagram of an exposure unit 150 that comprises a set of black lights BL (ultraviolet lights) and a set of white lights WL. The white lights WL are on and the black lights BL are off when the light box is being used to establish the pattern of open and closed areas on the printing screen 36. The structure shown by FIG. 28 is included in a housing like housing 44 and this housing includes a glass top. FIG. 28 shows end views of the black lights BL and the white lights WL. Each of these lights BL, WL are elongated such as light 42 shown in FIG. 27, and lights BL, WL are parallel to each other. The black lights BL are above reflectors R. The reflector regions above the white lights WL are open to form windows through which the white lights WL can emit their light. The system of FIG. 28 may include a switch S having an operator, e.g. a plunger P that is positioned to be struck by a frame portion of the printing screen 24, 46. For example, when a frame member 24 is lowered on the plunger P, the plunger P operates the switch S and causes the black lights BL to be turned on. Before this happens, the white lights WL may be on and the black lights may be off. In this case, when the plunger P is depressed, the circuit will turn off the white lights WL and at the same time turn on the black lights BL. The circuit associated with the switch S is a very basic circuit and for that reason is not illustrated in detail.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather are to be determined by the following claims, interpreted according to accepted doctrines of patent claim interpretation, including use of the doctrine of equivalents and reversal of parts.

What is claimed is:

1. A screen-printing machine, comprising:

a main frame including an elongated, horizontal support arm;

an exposure unit and a work piece table that are interchangeably mounted in a predetermined position on the support arm;

said exposure unit having a light transmitting top, a light below the top, and a frame member bordering the top, said frame member including a plurality of spaced apart locator pins that extend upwardly from said frame member;

a first light transmitting, positive image carrier positionable on said light transmitting top, said first positive image carrier including a plurality of locator openings in which the locator pins are received, said locator pins and said locator pin openings serving to position the first positive image carrier in a predetermined position on the top of the exposure unit; and a first positive image positioned at a predetermined location on the first positive image carrier.

2. The screen-printing machine of claim 1, comprising a second light transmitting positive image carrier positionable on the first light transmitting positive image carrier, said second positive image carrier including a plurality of locator openings in which the locator pins are received, said locator pins and said locator pin openings serving to position the second positive image carrier in a predetermined position on top of the first positive image carrier and the top of the exposure unit; and a second positive image positioned at a predetermined location on the second positive image carrier relative to the first positive image on the first positive image carrier.

3. The screen-printing machine of claim 2, comprising a third positive image carrier positionable on the second positive image carrier, said third positive image carrier including a plurality of locator openings in which the locator pins are received, said locator pins and said locator pin openings serving to position the third positive image carrier in a predetermined position on the second positive image carrier; and a third positive image positioned at a predetermined location on the third positive image carrier relative to the second positive image on the second positive image carrier and the first positive image on the first positive image carrier.

4. The screen-printing machine of claim 2, comprising a first printing screen and a second printing screen selectively positionable, one at a time, over the exposure unit.

5. The screen-printing machine of claim 4, comprising a common support for the first and second printing screens and the exposure unit, wherein each printing screen is positioned at a predetermined position on the exposure unit.

6. The screen-printing machine of claim 5, comprising a frame and a printing screen support mounted on the frame for rotation about a vertical axis, said printing screen support comprising a connector for each printing screen, wherein each said printing screen is positioned on the support to as to be selectively and individually positioned above the exposure unit by rotation of the support.

7. The screen-printing machine of claim 6, wherein each said printing screen occupies a predetermined position on the support relative to the exposure unit.

8. The screen-printing machine of claim 5, comprising a connector between the common support for the exposure unit and each printing screen which includes a detachable pin and socket connection adapted to allow each printing screen to be detached from the support and then reattached to the support at the same position that the printing screen previously occupied.

9. The screen-printing machine of claim 1, further comprising at lease one printing screen positionable above the first positive image carrier and the exposure unit.

10. The screen-printing machine of claim 9, wherein said at least one printing screen comprises three printing screens selectively positionable over the exposure unit, one at a time, in sequence.

11. The screen-printing machine of claim 10, comprising a frame and a printing screen support mounted on the frame for rotation about a vertical axis, said printing screen support comprising a connector for each said printing screen, wherein each said printing screen is positioned on the support so as to be selectively and individually positioned above the exposure unit by rotation of the support.

12. The screen-printing machine of claim 11, wherein each said printing screen occupies a predetermined position on the support relative to the exposure unit.

13. The screen-printing machine of claim 9, comprising a common support for the exposure unit and the printing screen, so that the printing screen occupies a predetermined position relative to the exposure unit.

14. The screen-printing machine of claim 13, comprising a connector between the common support for the exposure unit and the printing screen which includes a detachable pin and socket connection adapted to allow the printing screen to be detached from the support and then reattached to the support at the same position that the printing screen previously occupied.

15. The screen-printing machine of claim 13, wherein the common support includes said elongated, horizontal support arm and said exposure unit includes a tubular member having a center passageway that is sized and shaped to receive the support arm, and a clamp for clamping the exposure unit onto the support arm.

16. A screen-printing machine, comprising:

an exposure unit having a light transmitting top, a light below the top, and a frame member bordering the top, said frame member including a plurality of spaced apart locator pins that extend upwardly from said frame member and said frame member further including an end and an elongated tubular member having a center passageway opening at said end;

a light transmitting, positive image carrier positionable on said light transmitting top, said positive image carrier including a plurality of locator pin openings in which the locator pins are received, said locator pins and said locator pin openings serving to position the positive image carrier in a predetermined position on the top of the exposure unit;

a positive image positioned at a predetermined location on the positive image carrier;

a printing screen positionable above the positive image carrier and on the top of the exposure unit;

a common support for the exposure unit and the printing screen comprising a transverse frame member and an elongated arm connected to a central portion of the transverse frame member and extending from the transverse frame member into the center passageway of the elongated tubular member;

the printing screen having an end member positioned contiguous with said transverse frame member; and a plurality of pins and sockets for detachably connecting the end member of the printing screen to the transverse frame member to allow the printing screen to be detached from the support and then reattached to the support at the same position that the printing screen previously occupied.

17. The screen-printing machine of claim 16, wherein the sockets are located in the transverse frame member and the pins are carried by the end member of the printing screen frame.

18. The screen-printing machine of claim 16, comprising a clamp on said exposure unit for clamping the elongated tubular member in the exposure unit to the elongated arm that extends from the transverse frame member into the tubular member.

19. A screen-printing machine, comprising:

an exposure unit having a light transmitting top, a plurality of spaced apart black lights and a plurality of spaced apart white lights each located below the top, reflectors below the black lights, and window openings in the reflectors located above the white lights, the exposure unit further comprising a frame member bordering the top, said frame member including a plurality of spaced apart locator pins that extend upwardly from said frame member;

a light transmitting, positive image carrier positionable on said light transmitting top, said positive image carrier including a plurality of locator pin openings in which the locator pins are received, said locator pins and said locator pin openings serving to position the positive image carrier in a predetermined position on the top of the exposure unit;

a positive image positioned at a predetermined location on the positive image carrier;

a printing screen positionable above the positive image carrier and the exposure unit;

a common support for the exposure unit and the printing screen; and a connector between the common support for the exposure unit and the printing screen which includes a detachable pin and socket connection adapted to allow the printing screen to be detached from the support and then reattached to the support at the same position that the printing screen previously occupied.

20. The screen-printing machine of claim 19, comprising a switch on the exposure unit including an operator adapted to be contacted and depressed by the printing screen, to operate the switch and activate the black lights.

21. The screen-printing machine of claim 20, wherein the operator when depressed operates the switch to turn off the white lights.

22. A screen-printing machine, comprising:

an exposure unit having a light transmitting top, a light below the top, and a frame member bordering the top, said frame member including a plurality of spaced apart locator pins that extend upwardly from said frame member;

a first light transmitting, positive image carrier positionable on said light transmitting top, said first positive image carrier including a plurality of locator pin openings in which the locator pins are received, said locator pins and said locator pin openings serving to position the first positive image carrier in a predetermined position on the top of the exposure unit;

a first positive image positioned at a predetermined location on the first positive image carrier;

a second light transmitting positive image carrier positionable on the first light transmitting positive image carrier, said second positive image carrier including a plurality of locator openings in which the locator pins are received, said locator pins and said locator pin openings serving to position the second positive image carrier in a predetermined position on top of the first positive image carrier and on top of the exposure unit;

a second positive image positioned at a predetermined location on the second positive image carrier relative to the first positive image on the first positive carrier;

a first printing screen and a second printing screen selectively positionable, one at a time, over the exposure unit;

a common support for the first and second printing screens and the exposure unit, wherein each printing screen is positioned at a predetermined position on the exposure unit; and wherein said common support includes a frame and a printing screen support mounted on the frame for rotation about a vertical axis, said printing screen support comprising a connector for each printing screen, wherein each said printing screen is positioned on the support so as to be selectively and individually positionable above said exposure unit by rotation of the support.

23. A screen-printing machine, comprising:

an exposure unit having a light transmitting top, a light below the top, and a frame member bordering the top, said frame member including a plurality of spaced apart locator pins that extend upwardly from said frame member;

a light transmitting, positive image carrier positionable on said light transmitting top, said positive image carrier including a plurality of locator pin openings in which the locator pins are received, said locator pins and said locator pin openings serving to position the positive image carrier in a predetermined position on the top of the exposure unit;

a positive image positioned at a predetermined location on the positive image carrier, three printing screens selectively positionable over the exposure unit, one at a time, in sequence; and a frame and a printing screen support mounted on the frame for rotation about a vertical axis, said printing screen support comprising a connector for each said printing screen, wherein each said printing screen is positioned on the support so as to be selectively and individually positioned above the exposure unit by rotation of the support.

24. The screen-printing machine of claim 23, wherein each said printing screen occupies a predetermined position on the support relative to the exposure unit.

25. A screen-printing machine, comprising:

an exposure unit having a light transmitting top, a light below the top, and a frame member bordering the top, said frame member including a plurality of spaced apart locator pins that extend upwardly from said frame member;

a light transmitting, positive image carrier positionable on said light transmitting top, said positive image carrier including a plurality of locator pin openings in which the locator pins are received, said locator pins and said locator pin openings serving to position the positive image carrier in a predetermined position on the top of the exposure unit;

a positive image positioned at a predetermined location on the positive image carrier;

a first printing screen positionable above the positive image carrier and the exposure unit;

a common support for the exposure unit and the first printing screen; and a connector between the common support for the exposure unit and the first printing screen which includes a detachable pin and socket connection adapted to allow the first printing screen to be detached from the support and then reattached to the support at the same position that the printing screen previously occupied.

26. The screen-printing machine of claim 25, wherein the common support includes an elongated, horizontal support arm and said exposure unit includes a tubular member having a center passageway that is sized and shaped to receive the support arm, and a clamp for clamping the exposure unit onto the support arm.

27. A screen-printing machine, comprising:

an exposure unit having a light transmitting top, a light below the top, and a frame member bordering the top, said frame member including a plurality of spaced apart locator pins that extend downwardly from said frame member;

a first light transmitting positive image carrier positionable on said light transmitting top, said first positive image carrier including a plurality of locator pin openings in which the locator pins are received, said locator pins and said locator pin openings serving to position the first positive image carrier in a predetermined position on the top of the exposure unit;

a first positive image position at predetermined location on the first positive image carrier;

a second light transmitting, positive image carrier positionable on the first light transmitting positive image carrier, said second positive image carrier including a plurality of locator pin openings in which the locator pins are received, said locator pins and said locator pin openings serving to position the second positive image carrier in a predetermined position on the top of the first positive image carrier and on top of the exposure unit;

a second positive image positioned at a predetermined location on the second positive image carrier relative to the first positive image on the first positive image carrier;

a first printing screen and a second printing screen selectively positionable, one at a time, over the exposure unit;

a common support for the first and second printing screens and the exposure unit, wherein each printing screen is positioned at a predetermined position on the exposure unit, and a connector between the common support for the exposure unit each printing screen which includes a detachable pin and socket connection adapted to allow each printing screen to be detached from the support and then reattached to the support at substantially the same position that the printing screen previously occupied.

* * * * *